US010622181B2

(12) United States Patent
Scherer et al.

(10) Patent No.: US 10,622,181 B2
(45) **Date of Patent: *Apr. 14, 2020**

(54) NANOSCALE FIELD-EMISSION DEVICE AND METHOD OF FABRICATION

(71) Applicant: California Institute of Technology, Pasadena, CA (US)

(72) Inventors: Axel Scherer, Barnard, VT (US); William M. Jones, Pasadena, CA (US); Danil M. Lukin, Pasadena, CA (US); Sameer Walavalkar, Studio City, CA (US); Chieh-feng Chang, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 20 days.

This patent is subject to a terminal disclaimer.

(21) Appl. No.: 15/987,645

(22) Filed: May 23, 2018

(65) Prior Publication Data

US 2018/0277329 A1 Sep. 27, 2018

Related U.S. Application Data

(63) Continuation of application No. 15/442,408, filed on Feb. 24, 2017.

(Continued)

(51) Int. Cl.
*H01J 19/24* (2006.01)
*H01J 9/02* (2006.01)

(Continued)

(52) U.S. Cl.
CPC ..... *H01J 19/24* (2013.01); *H01J 9/025* (2013.01); *H01J 21/02* (2013.01); *H01J 21/105* (2013.01); *H01J 2209/0223* (2013.01)

(58) Field of Classification Search
CPC ..... H01L 2224/16225; H01L 2224/97; H01L 2924/01047; H01L 2924/01322;

(Continued)

(56) References Cited

U.S. PATENT DOCUMENTS 5,453,661 A 9/1995 Auciello et al.
9,680,116 B2 6/2017 Cao et al.

(Continued)

OTHER PUBLICATIONS

TKS Wong and SG Ingram Observational of Fowler-Nordheim Tunnelling at Atmospheric Pressure Using Au/Ti Lateral Tunnel Diodes, 1993 J. Phys. D: Appl. Phys. 26 979 (Year: 1993).*

(Continued)

*Primary Examiner* — Robert G Bachner
(74) *Attorney, Agent, or Firm* — Kaplan Breyer Schwarz, LLP

(57) ABSTRACT

Nanoscale field-emission devices are presented, wherein the devices include at least a pair of electrodes separated by a gap through which field emission of electrons from one electrode to the other occurs. The gap is dimensioned such that only a low voltage is required to induce field emission. As a result, the emitted electrons energy that is below the ionization potential of the gas or gasses that reside within the gap. In some embodiments, the gap is small enough that the distance between the electrodes is shorter than the mean-free path of electrons in air at atmospheric pressure. As a result, the field-emission devices do not require a vacuum environment for operation.

20 Claims, 15 Drawing Sheets

Related U.S. Application Data

(60) Provisional application No. 62/437,806, filed on Dec. 22, 2016.

(51) Int. Cl.
*H01J 21/02* (2006.01)
*H01J 21/10* (2006.01)

(58) Field of Classification Search
CPC ..... H01L 23/49827; H01L 29/7869; H01J 1/304; H01J 9/025; H01J 9/027; H01J 1/316; H01J 19/24; H01J 21/02; H01J 2209/0223; C12Q 1/6851; C12Q 1/68; C12Q 2527/101; C12Q 561/113; C12Q 2565/101; C12Q 2565/1015; C12Q 2565/133; C12Q 2537/143; C12Q 2537/165; C12Q 2565/629; C12Q 1/6816; C12Q 1/6874; C12Q 1/689; C12Q 1/701; C12Q 1/703; C12Q 2600/158; C12Q 2535/125; C12Q 2537/101; C12Q 2563/107; C12Q 1/6825; C12Q 1/6832; C12Q 1/6837; C12Q 1/686; C12Q 1/6883; C12Q 2600/156; A61B 5/1459; A61B 5/14532; A61B 5/14865; A61B 5/1473; A61B 2560/0219
See application file for complete search history.

(56) References Cited

U.S. PATENT DOCUMENTS

2007/0215861 A1* 9/2007 Stafford ..... H01L 51/0504 257/24
2011/0101302 A1* 5/2011 Zhou ..... B82Y 10/00 257/13
2017/0250048 A1* 8/2017 Scherer ..... H01J 21/105

OTHER PUBLICATIONS

"Notice of Allowance" issued in parent U.S. Appl. No. 15/442,408, dated May 17, 2018.
"Non-Final Office Action" issued in parent U.S. Appl. No. 15/442,408, dated Oct. 6, 2017.
Lin Wang et al., "High-temperature stable field emission of B-doped Sic nanoneedle arrays", "Nanoscale, DOI: 10.1039/C5NR00952A", dated Apr. 1, 2015, Publisher: Royal Society of Chemistry.
Ebrahim Forati et al., "Photoemission-based microelectronic devices", "nature Communications", DOI: 10.1038/ncomms13399, dated Nov. 4, 2016, Published in: US.
R. H. Ritchie, "Plasma Losses by Fast Electronics in Thin Films", "Physical Review", dated Jun. 1, 1957, pp. 874-881, vol. 106, No. 5.
Damien Canneson et al., "Surface plasmon polariton beams from an electrically excited plasmonic crystal", "Optics Express", http://dx.doi.org/10.1364/OE.24.026186, dated Nov. 14, 2016, vol. 24, No. 23, Publisher: Optical Society of America, Published in: US.

* cited by examiner cross-sectional view through line a-a cross-sectional view through line b-b

NANOSCALE FIELD-EMISSION DEVICE AND METHOD OF FABRICATION

RELATED APPLICATIONS

This application is a continuation of co-pending U.S. Non-provisional application Ser. No. 15/442,408, filed Feb. 24, 2017 , which claims the benefit of U.S. Provisional Application No. 62/299,974 filed Feb. 25, 2016 and U.S. Provisional Application No. 62/437,806, filed Dec. 22, 2016, each of which is incorporated herein by reference.

FIELD OF THE INVENTION

The present invention relates to microelectronic devices and, more particularly, to field-emission-based circuit elements.

BACKGROUND OF THE INVENTION

Solid-state electronics were developed, in part, because vacuum-tube-based electron-emission electronics systems were fraught with reliability issues, dissipated large amounts of power, and generated inordinate amounts of heat. In addition, the integration capability of vacuum tubes was limited to what could be included within one vacuum-sealed ampule or tube.

The reliability issues of vacuum tubes arise due primarily to the electron emission sources, which must be heated to very high temperatures to efficiently provide electrons by a process called "thermionic emission." Thermionic emission is a process wherein electric current is passed through a metal filament to heat it and increase its temperature such that electrons gain enough thermal energy for them to overcome the work function of the metal and escape into the free space around the filament. Unfortunately, when a metal filament is heated to the required temperature to enable thermionic emission, metal from the filament can evaporate making the filament brittle and susceptible to burning out and/or cracking.

Unfortunately, semiconductor-based, solid-state electronics devices have a limited temperature range over which they can operate. Silicon-based electronics, for example, are limited to approximately 300° C., while so-called high-temperature electronics based on silicon carbide, gallium nitride, or diamond can operate only up to approximately 450° C. In addition, semiconductor-based devices are highly susceptible to damage from ionizing radiation, which can generate defects in the semiconductor material that can serve as traps that degrade charge-carrier mobility and lifetime.

As a result, renewed interest in integrated electron-emission devices has arisen due to their capability for high-frequency operation, ability to operate at high temperatures, and their inherent resistance to ionizing radiation.

To date, individual electron-emission devices having operating frequencies in the GHz range have been demonstrated, such as those disclosed by Spindt, et al., in "Progress in field-emitter array development for high-frequency operation," in *The Technical Digest of the Electron Devices Meeting—IEDM* '93, pp. 749-752 (1993), which is incorporated herein by reference.

In addition, electron-emission devices that can operate at temperatures well above the temperatures at which solid-state transistors fail have also been demonstrated, such as silicon-carbide needle arrays that operate at 500° C., as disclosed by Wang, et al., in "High-temperature stable field-emission of b-doped SiC nanoneedle arrays," in *Nanoscale*, Vol. 7, pp. 7585-7592 (2015), which is incorporated herein by reference.

Further, as known in the art, carrier lifetime is less critical for operation of field-emission devices; therefore, such devices are well suited for radiation-hard electronics applications.

Unfortunately, conventional electron-emission devices disclosed to date have been difficult to fabricate individually, much less as part of complex integrated circuits. Furthermore, prior-art field-emission devices have relied upon the use of backplane gating, which makes difficult or precludes independent operation of different devices on the same chip.

The need for an electron-emission technology suitable for integration into high-functionality integrated circuits remains, as yet, unmet in the prior art.

SUMMARY OF THE INVENTION

The present invention enables operation of a field-emission device without inducing thermionic emission or impact ionization in the region between the electrodes of the device.

Embodiments of the present invention employ emitter and collector electrodes that are separated by a gap that is small enough to enable the application of a low voltage between the emitter and collector to generate an electric field sufficient to induce electron emission from one of the electrodes. Since the applied voltage is low, the energy of the emitted electrons is below the ionization potential of the gas or gasses residing in the gap, thereby mitigating impact ionization of the gas molecules by the emitted electrons and the resultant electrode damage. Further because devices in accordance with the present invention operate by cold field emission only, they experience less electrode degradation and failure due to high-temperature heating than prior-art field-emission devices based on thermionic emission. Still further, in some embodiments, the gap is 200 nm or less; therefore, the travel distance of emitted electrons is less than the mean free path of electrons in air, making operation at atmospheric pressure a possibility. Embodiments of the present invention are well suited for use in any integrated circuit application and are particularly well suited for applications requiring high-frequency and/or high-temperature operation.

An illustrative embodiment of the present invention is a diode comprising an emitter electrode and a collector electrode having a gap of 22 nm between them. The emitter and collector comprise single-crystal silicon that is doped with phosphorous such that it is electrically conductive. The emitter and collector are formed by etching the active layer of a silicon-on-insulator wafer and providing electrical contacts to each electrode. In some embodiments, some or all of the exposed regions of the buried oxide layer of the wafer are etched back to increase the oxide path between the electrodes and reduce leakage current.

In some embodiments, the emitter and collector are formed by etching the active layer to define a continuous region of silicon comprising the emitter, the collector, and a narrow neck that connects them such the regions and neck are contiguous. Once this region is formed, its outer surface is oxidized such that the silicon of the neck is converted entirely into silicon dioxide. The silicon dioxide is then removed in a selective oxide etchant such that the removal of the neck forms the gap between the emitter and collector.

In some embodiments, the emitter and collector comprise metal that is defined via conventional lithography and etching or lift-off.

In some embodiments, the emitter and collector are made of different conductive materials having different work functions, which enables rectified operation due to the fact that the ease of emission is exponentially dependent on the work function of the emitting material so that a material having a lower work function will emit at a lower voltage than a high work function material.

In some embodiments, one or more gate electrodes are included, where the gates are separated from one or both of the emitter and collector by a small gap. In such embodiments, the magnitude of the field-emission current between the emitter and collector is controlled by controlling the voltage applied to the gate.

In some embodiments, the gate is formed such that it is included in a stacked structure that includes one of the emitter and collector, where the gate and the emitter/collector are separated by an insulator. In some embodiments, the emitter and collector are included in different stacked structures, each of which includes a gate electrode and an insulator that separates the emitter/collector from its respective gate. In some such embodiments, the voltages applied to each gate electrodes is independently controllable.

An embodiment of the present invention is an apparatus including a first field-emission device, the first field-emission device comprising: a substrate; a first electrode disposed on the substrate; and a second electrode disposed on the substrate, wherein the first electrode and second electrode define a first gap having a first environment that is characterized by an ionization potential; wherein the first gap has a first separation that enables field emission of electrons from one of the first electrode and second electrode with an electron energy that is less than the ionization potential.

Another embodiment of the present invention is an apparatus including a first field-emission device, the first field-emission device comprising: a substrate; a first electrode disposed on the substrate; and a second electrode disposed on the substrate, wherein the first electrode and second electrode are co-planar and define a first gap having a first environment that is characterized by an ionization potential; wherein, when a first voltage is applied between them, the first and second electrodes generate a first in-plane, field-emission current of electrons having energy that is less than the ionization potential.

Yet another embodiment of the present invention is a method comprising: forming a first electrode on a substrate, the first electrode comprising a first material that is electrically conductive; and forming a second electrode on the substrate, the second electrode comprising a second material that is electrically conductive; wherein the first electrode and second electrode collectively define a first gap having an environment that is characterized by an ionization potential; and wherein the first and second electrodes are dimensioned and arranged such that they enable field emission of electrons from one of the first electrode and second electrode with an electron energy that is less than the ionization potential.

DETAILED DESCRIPTION

Figure 1A:
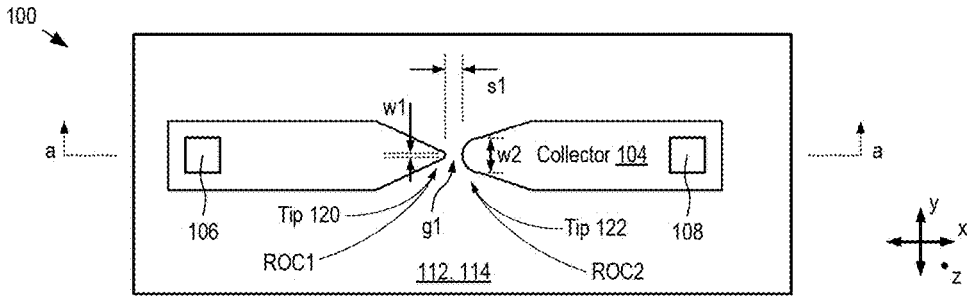
FIGS. 1A-B depict schematic drawings of top and cross-sectional views, respectively, of a field-emission device in accordance with an illustrative embodiment of the present invention.
Figure 1B:
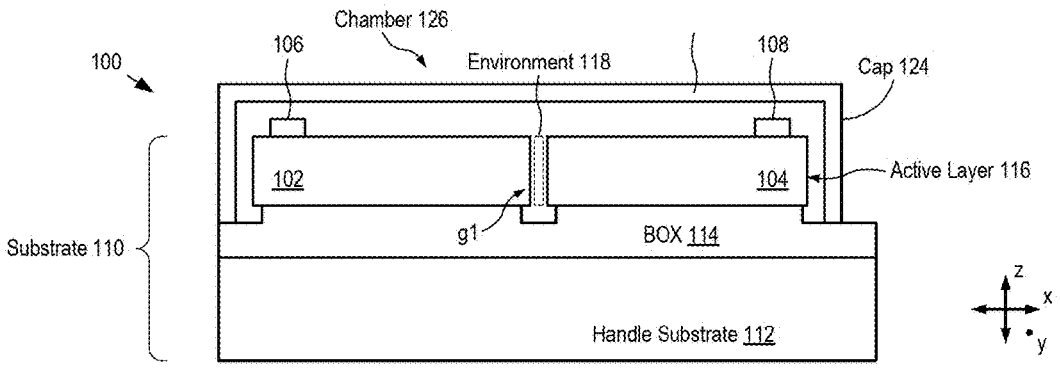

FIGS. 1A-B depict schematic drawings of top and cross-sectional views, respectively, of a field-emission device in accordance with an illustrative embodiment of the present invention. Device 100 is an edge-emitting, two-terminal field-emission device having an asymmetric current-voltage characteristic, which enables the device to operate in diode-like fashion. Device 100 includes emitter 102 and collector 104. The cross-sectional view of device 100 depicted in FIG. 1B is taken though line a-a as shown in FIG. 1A.

Figure 2:
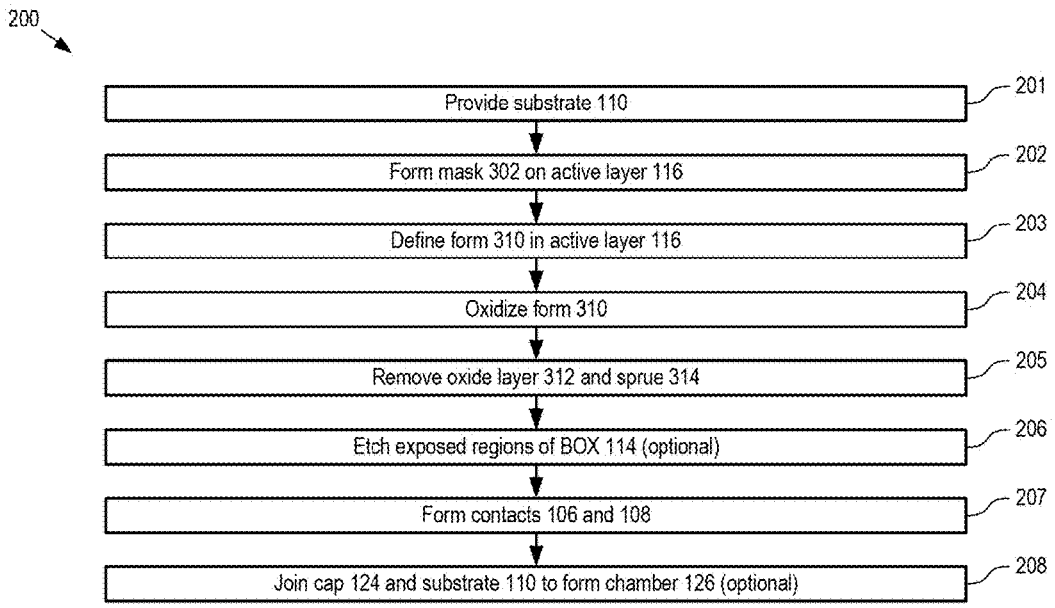
FIG. 2 depicts operations of a method for forming a field-emission device in accordance with the illustrative embodiment.

FIG. 2 depicts operations of a method for forming a field-emission device in accordance with the illustrative embodiment. Method 200 begins with operation 201, wherein substrate 110 is provided. Method 200 is described herein with continuing reference to FIGS. 1A-B, as well as reference to FIGS. 3A-D.

FIGS. 3A-E depict schematic drawings of top and cross-sectional views (though line a-a) of a nascent field-emission device at different stages of its fabrication.

Substrate 110 is a convention silicon-on-insulator (SOI) wafer including handle substrate 112, buried oxide layer (BOX) 114, and active layer 116.

Handle substrate 112 is a conventional silicon wafer.

BOX 114 is a conventional buried oxide layer comprising silicon dioxide and has a thickness suitable for substantially isolating active layer 116 from handle substrate 112. In the depicted example, BOX 114 has a thickness of approximately 2 microns.

Active layer 116 is a layer of single-crystal silicon having a thickness substantially equal to the desired thickness of emitter 102 and collector 104. In the depicted example, active layer 116 has a thickness of approximately 220 nanometers (nm) and is highly doped with phosphorous such that it has low resistance at room temperature. In some embodiments, additional doping of active layer 116 is performed to enhance its conductivity.

At operation 202, mask 302 is formed on the top surface of active layer 116. Mask 302 must be suitable for use in a deep-reactive-ion etch (DRIE) used etch completely through the active layer. As a result, it is preferable that mask 302 is a hard mask (e.g., patterned metal, etc.); however, in some embodiments, a conventional thick-film photoresist is used for mask 302.

Mask 302 includes fields 304, 306, and 308, which correspond to the shapes of nascent emitter 310, nascent collector 312, and neck 314, as discussed below. Fields 304, 306, and 308 are contiguous such that they collectively define a continuous mask region. In the depicted example, fields 304 and 306 are slightly larger than the desired sizes of emitter 102 and collector 104 to accommodate the formation of oxide layer 312, as discussed below.

Figure 3A:
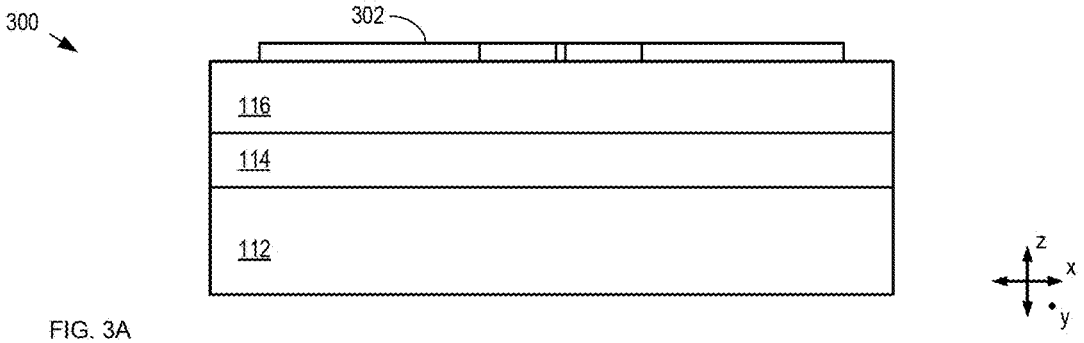
FIGS. 3A-E depict schematic drawings of top and cross-sectional views (though line a-a) of a nascent field-emission device at different stages of its fabrication.
Figure 3B:
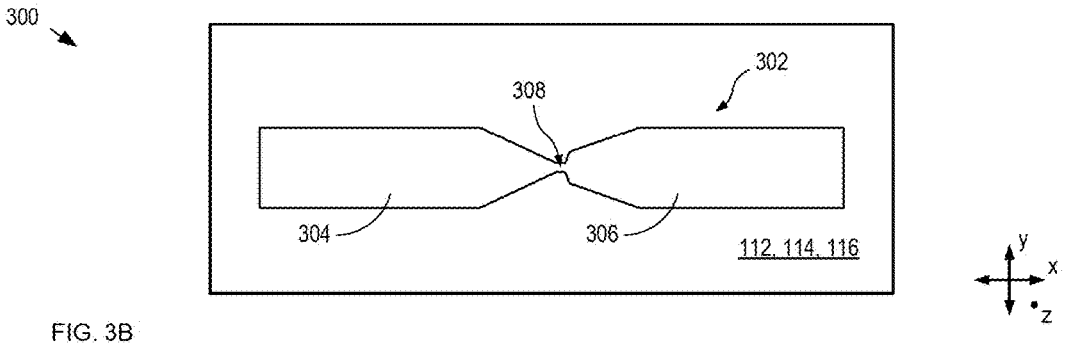

FIGS. 3A-B depict cross-sectional and top views, respectively, of nascent device 300 after the formation of mask 302.

At operation 203, the pattern of mask 302 is transferred into active layer 116 via conventional DRIE to define form 316, which includes contiguous nascent emitter 310, nascent collector 312, and neck 314.

Figure 3C:
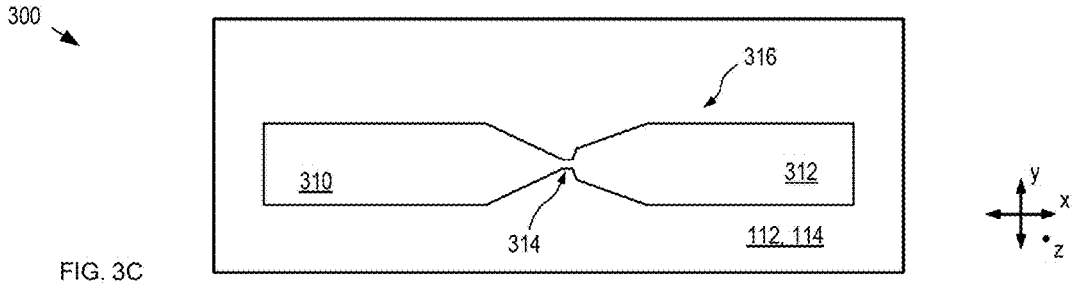

FIG. 3C depicts a top view of form 316 after operation 203.

At operation 204, the outer surface of form 316 is oxidized to form oxide layer 318. During the oxidation of form 316, the silicon in neck 314 is entirely consumed by the formation of silicon dioxide, thereby converting neck 314 into sprue 320.

Figure 3D:
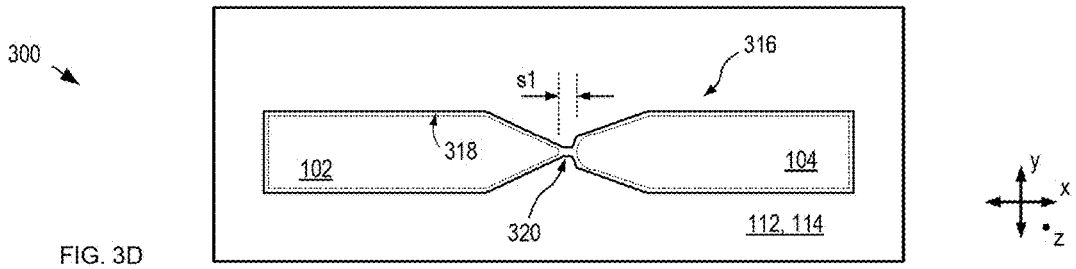

FIG. 3D depicts a top view of nascent device 300 after the formation of oxide layer 318.

At operation 205, oxide layer 318 and sprue 320 are removed in a selective oxide etch, such as buffered oxide etch (BOE), to realize emitter 102, collector 104, and gap g1 having separation s1. In the depicted example, s1 is equal to 22 nm. In some embodiments, s1 is a different separation within the range of approximately 1 nm to approximately 200 nm.

Typically, oxide layer 318 and sprue 320 are removed via a wet etch, such as BOE or hydrofluoric acid; however, one skilled in the art will recognize that any etch, wet or dry, that attacks silicon dioxide significantly faster than silicon can be used without departing from the scope of the present invention.

Figure 3E:
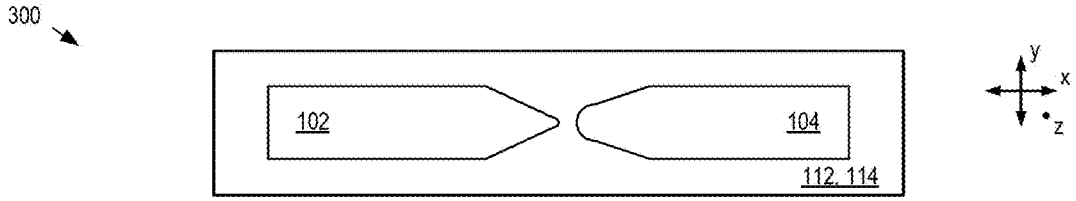

FIG. 3E depicts a top view of nascent device 300 after the removal of oxide layer 312.

It should be noted that the formation of gap g1 via oxidation of neck 314 and its subsequent removal affords some embodiments of the present invention with advantages over prior-art integrated field-emission devices. One skilled in the art will recognize that, even when using electron-beam (i.e., e-beam) lithography, the definition of mask openings on the scale of tens of nanometers is challenging. The inclusion of neck 308 in mask 302 alleviates this need, however, since form 316 includes only regions that are contiguous. Further, oxidation of silicon is well-understood and highly controllable. The combination of the lithographic definition of neck 308 and the controllable thickness of oxide layer 318, therefore, enable precise control over the shape of tips 120 and 122 and their radii of curvature and/or minimum widths, w1 and w2, and the final dimension of gap g1—enabling formation of gaps having well-controlled separations within the range of a few nm to 200 nm.

In the depicted example, emitter 102 includes tip 120, which has a rounded end having a radius of curvature of ROC1. In similar fashion, collector 104 includes tip 122, which has a rounded end having a radius of curvature of ROC2. Exemplary values for ROC1 and ROC2 are 20 nm and 160 nm, respectively; however, other radii can be used without departing from the scope of the present invention. In some embodiments, at least one of tips 120 and 122 terminates in a substantially flat surface that defines a minimum width for that electrode. One skilled in the art will recognize that a substantially flat surface has a radius of curvature that is infinite. For electrodes having flat tips, the minimum width would approximately equal twice the radius of curvature of a comparable rounded tip. For the purposes of this Specification, including the appended claims, the term "minimum width" is defined as the narrowest width along the length of the tip of an electrode (e.g., a collector, emitter, or gate), which is typically where the electrode terminates at the field-emission gap.

Operating voltage for a field-emission device is a function of both electrode-tip radius-of-curvature (or minimum tip width) and gap separation. For sharper electrode tips, stronger electric fields can be generated, even with larger electrode gaps, at lower voltages applied between the emitter and collector. When the radius of curvature of an electrode tip becomes less than about 20 nm, however, the tip becomes highly susceptible to damage during operation. In the prior art, operation at modest voltages has been demonstrated using extremely sharp electrode tips to enhance field strength. For instance, very low voltage turn-on devices have been fabricated in doped silicon by taking advantage of ultra-sharp atomic protrusions from individual dopants atoms, as disclosed by Pescini, et al., in "Nanoscale lateral field-emission triode operating at atmospheric pressure," in *Advanced Materials*, Vol. 13, pp. 1780-1783 (2001), which is incorporated herein by reference. Unfortunately, repeatable fabrication of such prior-art electrode tips is challenging, which makes their use in commercially viable devices and/or integrated circuits impractical. In addition, such prior-art tips are highly susceptible to damage and failure from surface changes due to contamination and/or impact of ionized particles.

In the present invention, however, the shape of the emitter and collector electrodes is lithographically defined to be narrow and extremely close together so that the field enhancement that they need to operate at low voltages is small, which allows the use of relatively wider (as compared to the prior art) and, consequently, more robust tips. Because their shapes are lithographically defined, electrodes in accordance with the present invention are manufacturable and commercially viable. As a result, they are more robust and less susceptible to damage during operation, since many nearly identical emission sites on the same tip that become active if the initial emission site is destroyed or contaminated. It is an aspect of the present invention that each of emitter 102 and collector 104 has a minimum tip width of at least 40 nm (i.e., a radius of curvature of at least 20 nm), which affords embodiments of the present invention better reliability than can be attained in the prior art.

It is an aspect of the present invention that lithographically defined electrodes having tip radii of at least 20 nm and a narrow emitter-collector gap (s1≤100 nm) enable a practical field-emission device to generate an electric field strong enough to induce cold field emission with a very low voltage applied between the emitter and collector (typically ≤12 V). The ability to operate at low voltage affords embodiments of the present invention several advantages over prior-art field-emission devices. First, it enables the energy of the emitted electrons to be kept below the ionization potential of the gas or gasses residing within the gap (i.e., in environment 118). As a result, impact of energetic gas atoms on the electrodes is reduced or eliminated.

Second, thermionic emission of electrons is avoided. Damage from thermionic emission and impact of energetic gas molecules are well-known causes of electrode degradation and failure in prior-art field-emission devices; therefore, field-emission devices in accordance with the present invention can have higher reliability and longer lifetimes.

Third, when the emitter-collector gap is 200 nm or less, the distance that the emitted electrons must travel is shorter than the mean free path of electrons in air at atmospheric pressure. As a result, electrons are statistically likely to travel from the cathode to the anode without colliding with a gas molecule. Many prior-art field-emission devices require packaging under vacuum to reduce the likelihood of collisions between emitted electrons and gas molecules in the space between their emitters and collectors, which can lead to electron scattering and impact ionization of the gas molecules themselves. In contrast, due to the short travel distance of emitted electrons, devices in accordance with the present invention do not require high vacuum conditions and, in fact, can operate even at atmospheric pressure. Less complexity is required, therefore, enabling lower cost devices and systems.

Fourth, a sufficiently low operating voltage enables a field-emission device to be compatible with the typical operating voltages of conventional CMOS integrated circuits making mixed-technology integrated circuits feasible.

One skilled in the art will recognize, after reading this Specification, that Frenkel-Poole current leakage along the surface of BOX layer 114 between the emitter and collector can be problematic in integrated high-electric-field devices—particularly at higher operating temperatures. In fact, as operating temperature increases, such leakage can begin to compete with the Fowler-Nordheim field-emission upon which the operation of field-emission devices in accordance with the present invention depend. It is an aspect of the present invention that, by increasing the surface distance between the emitter and collector electrodes, Frenkel-Poole current leakage can be reduced.

At optional operation 206, the surfaces of the exposed regions of BOX 114 are relieved slightly by etching the BOX layer in a selective oxide etch. By relieving these surfaces, the length of leakage paths along the surface of the BOX layer between emitter 102 and collector 104 are increased, mitigating Frenkel-Poole current leakage. In some embodiments, the surfaces of the exposed region of BOX 114 are relieved by simply extending the duration of the oxide etch used in operation 205.

At operation 207, contacts 106 and 108 are formed on emitter 102 and collector 104, respectively, thereby completing the fabrication of device 100.

One skilled in the art will recognize, after reading this Specification, that the dimensions and materials of device 100, as described above, are exemplary only and that any suitable practical dimensions and/or materials can be used for any of element of field-emission devices in accordance with the present invention.

In some embodiments, emitter 102 and collector 104 are defined directly using fine-line lithography, such as conventional e-beam lithography, and conventional patterning processes (e.g., subtractive patterning via etching, lift-off, etc.). In some embodiments, at least one of emitter 102 and collector 104 is a metal electrode formed directly on an electrically insulating layer via lithography and metal deposition and patterning (e.g., etching, lift-off, etc.). Metals suitable for use for electrodes in accordance with the present invention include, without limitation, tungsten, molybdenum, titanium-tungsten, titanium, gold, chromium, and the like. In some embodiments, metal layers are formed on the top surface of semiconductor electrode structures, such as electrodes 102 and 104.

Still further, in some embodiments, emitter 102 and collector 104 comprise different materials having different work functions. Cold field emission in device 100 requires generation of a high electric field across gap g1 to "bend" the vacuum level such that the vacuum state of the electrode material drops to the energy of the conduction band electrons near the electrode surface (within ~10 nm). For a good conductor, such as a metal, most electrons lie in the conducting band of the material. Therefore, the vacuum level must be lowered by at least the value of the work function of the emitting material to initiate turn-on of field emission. As a result, the use of different materials for the emitter and collector gives rise to a different turn-on voltage depending upon which electrode is emitting electrons—i.e., such a device provides rectification.

At optional operation 208, cap 124 and substrate 110 are joined to collectively define chamber 126. Chamber 126 encloses emitter 102 and collector 104 to provide environment 118, which resides within gap g1.

In the depicted example, cap 124 is a conventional silicon substrate having an inner surface that is recessed to accommodate the structure of device 100. In some embodiments, cap 124 is another suitable structure.

Figure 4:
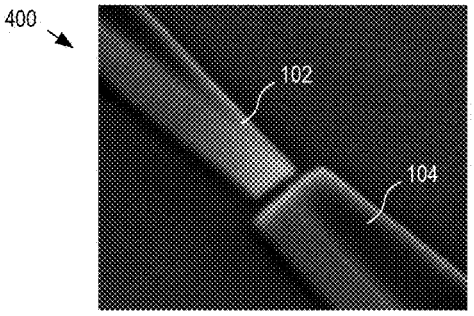
FIG. 4 depicts a scanning-electron-microscope photograph of a two-terminal field-emission device in accordance with the present invention.

FIG. 4 depicts a scanning-electron-microscope photograph of a two-terminal field-emission device in accordance with the present invention.

In the depicted example, tip 120 of emitter 102 is relatively sharper than tip 122 of collector 104. This difference in tip sharpness affords device 100 an asymmetric current-voltage characteristic, which enables device 100 to replicate the functionality of conventional solid-state diodes. Specifically, when device 100 is biased to emit electrons from emitter 102, such emission occurs at a lower voltage because the relatively sharper tip 120 realizes greater static-field enhancement than the relatively blunter tip 122.

In some embodiments, at least one of tip 120 and 122 is made sharper via an additional sharpening process, such as wet etching, dry etching, etching in a crystallographic-dependent etch (e.g., potassium-hydroxide (KOH), ethylene diamine pyrocatechol (EDP), hydrazine, etc.), or similar process.

Figure 5:
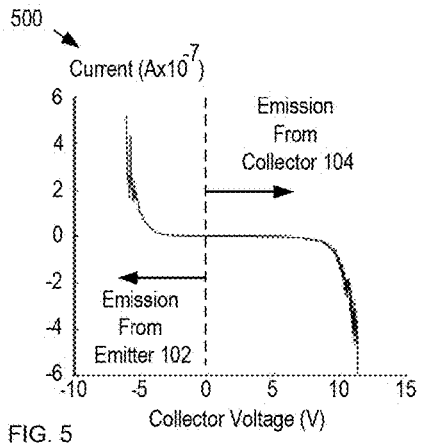
FIG. 5 depicts a plot of a current-voltage curve for a two-terminal field-emission device in accordance with the present invention.

FIG. 5 depicts a plot of a current-voltage curve for a two-terminal field-emission device in accordance with the present invention. Plot 500 shows that emission from emitter 102 begins at approximately 5.2 volts, while emission from collector 104 begins at approximately 11.0 volts.

Figure 6:
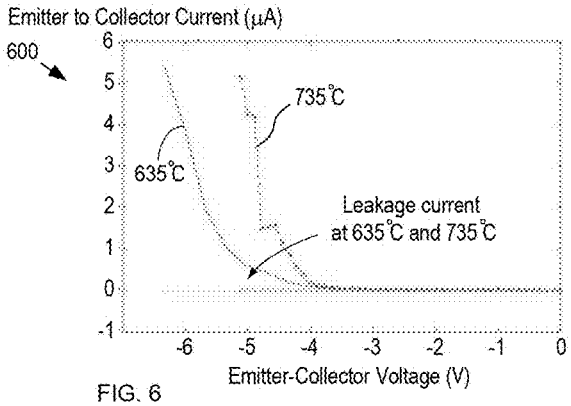
FIG. 6 depicts a plot of high-temperature-operation current-voltage curves for a two-terminal field-emission device in accordance with the present invention.

FIG. 6 depicts a plot of high-temperature-operation current-voltage curves for a two-terminal field-emission device in accordance with the present invention. Plot 600 evinces that, while changes in temperature affect the operation, devices in accordance with the present invention function at temperatures well above those at which conventional solid-state devices, or even high-temperature silicon-carbide devices, fail.

Figure 7:
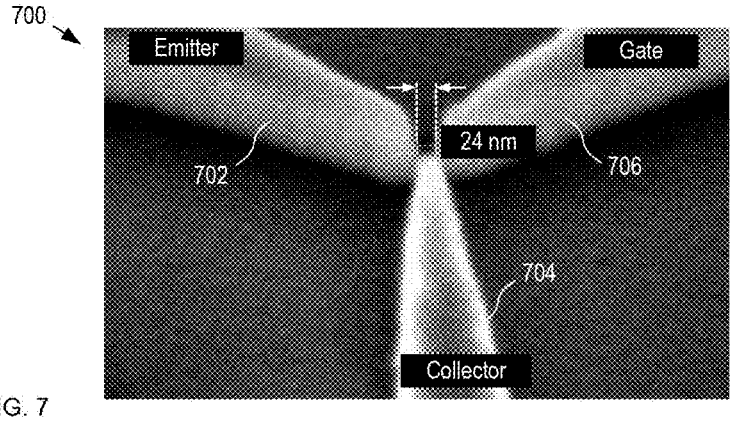
FIG. 7 depicts a scanning-electron-microscope photograph of a three-terminal field-emission device in accordance with the present invention.

FIG. 7 depicts a scanning-electron-microscope photograph of a three-terminal field-emission device in accordance with the present invention. Device 700 is analogous to device 100; however, device 700 includes an additional gate electrode that enables control over the field-emission current between its emitter and collector. Device 700 includes emitter 702, collector 704, and gate 706, each of which is formed on substrate 110 as described above.

Figure 8:
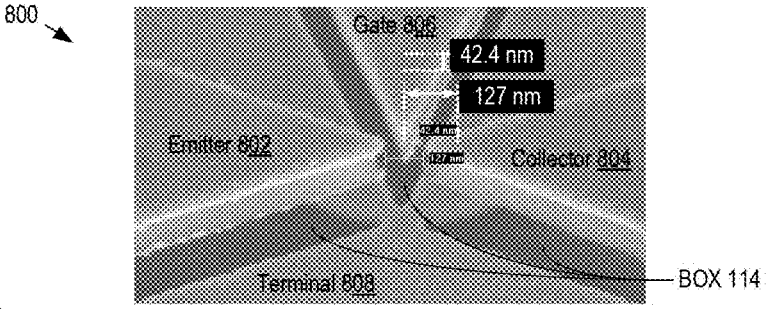
FIG. 8 depicts a scanning-electron-microscope photograph of a four-terminal field-emission device in accordance with the present invention.

FIG. 8 depicts a scanning-electron-microscope photograph of a four-terminal field-emission device in accordance with the present invention. Device 800 is analogous to device 700; however, device 800 includes an additional gate electrode, disposed on the substrate surface, which enables additional control over the field-emission current between its emitter and collector. Device 800 includes emitter 802, collector 804, gate 806, and terminal 808, each of which is formed on substrate 110.

Each of emitter 802, collector 804, and gate 806 includes a metal layer formed on its top surface by e-beam evaporation after operation 206 of method 200. During this evaporation, each of these electrodes acts as a shadow mask that enables deposition of metal on the top surface of BOX 114. By virtue of the shadow-mask functionality of the emitter, collector, and gate, terminal 808 is electrically disconnected from the each of these electrodes.

Figure 9A:
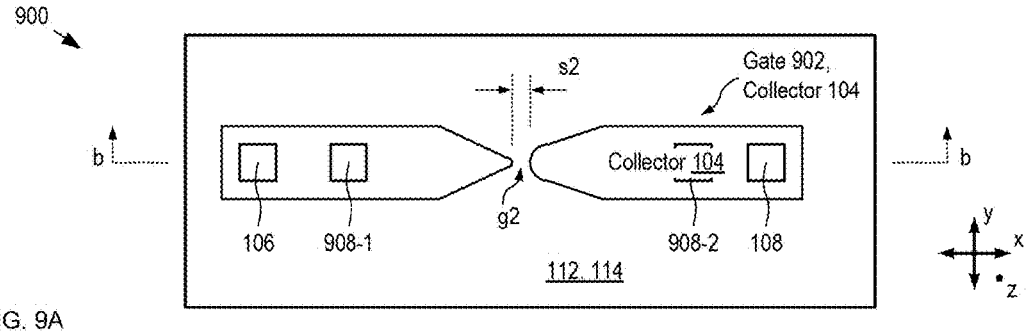
FIGS. 9A-B depict top and cross-sectional views of a four-terminal field-emission device in accordance with a first alternative embodiment of the present invention.
Figure 9B:
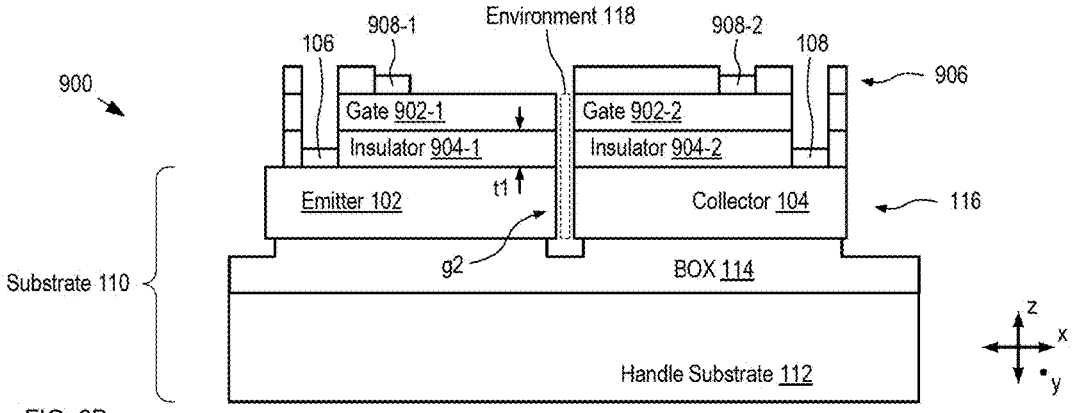

FIGS. 9A-B depict top and cross-sectional views of a four-terminal field-emission device in accordance with a first alternative embodiment of the present invention. Device 900 is an edge-emitting field-emission triode comprising emitter 102, collector 104, and gates 902-1 and 902-2. The cross-sectional view of device 900 depicted in FIG. 9B is taken though line b-b as shown in FIG. 9A.

The addition of gates 902-1 and 902-2 enable modulation of the emission current between emitter 102 and collector 104. In some embodiments, gates 902-1 and 902-2 are electrically independent of one another within device 900, which enables them to be independently addressed. In some embodiments, the gates are electrically connected within device 900 and, therefore, function as a single gate for the device. Application of a relative voltage to one or both gates increases or decreases the electric field at the emitter and/or collector tip, which influences the strength of the electric field between the emitter and collector producing modulation of the field-emission current. An individually addressable gate electrode represents a significant improvement over the backplane gating used in the prior art, since it enables individual field-emission devices of a field-emission-based integrated circuit to be independently controlled. Independent device control is necessary to enable a practical field-emission-device integrated-circuit.

Figure 10:
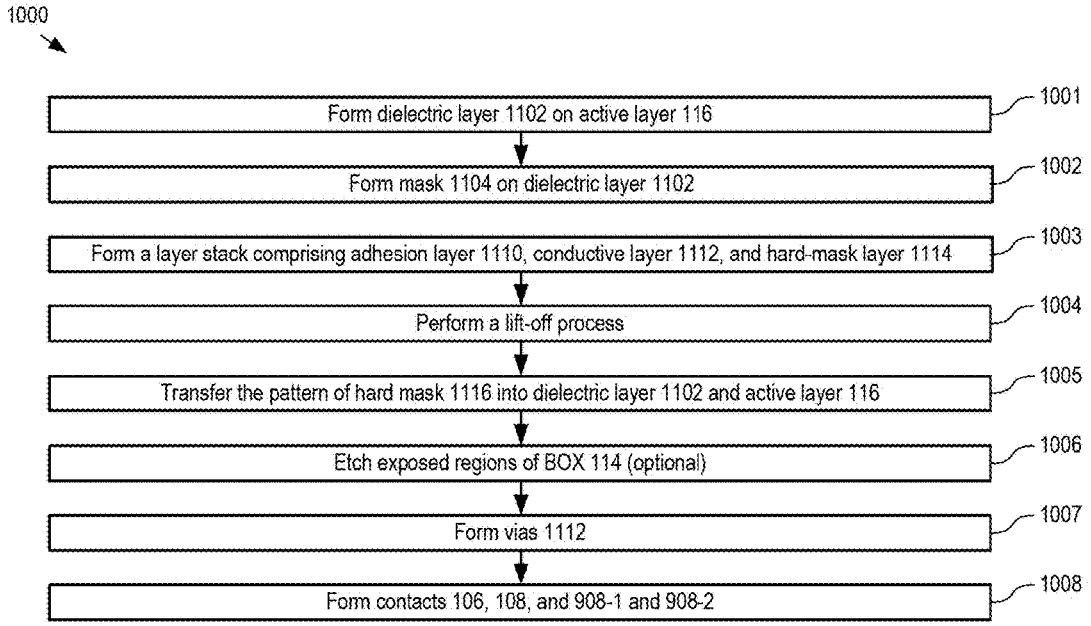
FIG. 10 depicts operations of a method for fabricating a field-emission device in accordance with the first alternative embodiment.

FIG. 10 depicts operations of a method for fabricating a field-emission device in accordance with the first alternative embodiment. Method 1000 begins with operation 1001, wherein dielectric layer 1102 is formed on active layer 116 of substrate 110. Method 1000 is described herein with continuing reference to FIGS. 9A-B, as well as reference to FIGS. 11A-D.

FIGS. 11A-F depict schematic drawings of top and cross-sectional views (though line b-b) of a nascent field-emission device at different stages of its fabrication.

In the depicted example, prior to the formation of dielectric layer 1102, the surface dopant concentration of active layer 116 is increased by depositing a phosphorous-doped spin-on layer on the top surface of the active layer. In some embodiments, the doping concentration of active layer 116 is adjusted by another conventional method, such as ion implantation, solid-source doping, etc. In some embodiments, the doping concentration of the active layer is not adjusted.

Dielectric layer 1102 is a layer of aluminum oxide ($Al_2O_3$) having a thickness of approximately 20 nm. Preferably, the dielectric layer is formed via atomic-layer deposition (ALD); however, any conventional method for forming the dielectric layer can be used without departing from the scope of the present invention. In some embodiments, dielectric layer 1102 comprises a dielectric other than aluminum oxide.

At operation 1002, mask 1104 is formed on the top surface of dielectric layer 1102. Mask 1104 is a lift-off mask comprising a layer of polymethylmethacrylate (PMMA) that includes features 1106 and 1108, which are openings in the mask having the desired shape of emitter 102 and collector 104, respectively. In some embodiments, mask 1104 is not a lift-off mask but, rather, a conventional mask suitable for protecting the regions of the emitter and collector during a subsequent DRIE process used to define them. The use of a lift-off mask, however, enables a smaller gap g2 to be produced because small positive features in a mask can normally be made more easily and reproducibly than small openings in a mask.

Figure 11A:
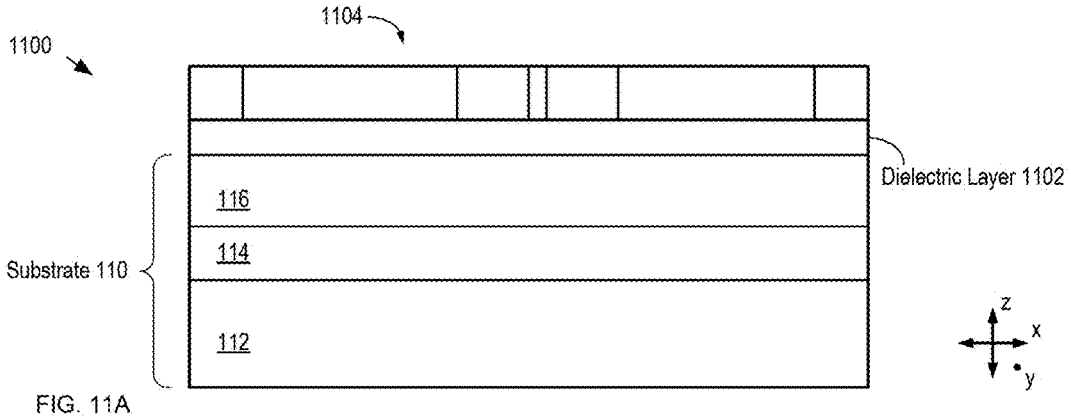
FIGS. 11A-F depict schematic drawings of top and cross-sectional views (though line b-b) of a nascent field-emission device at different stages of its fabrication.
Figure 11B:
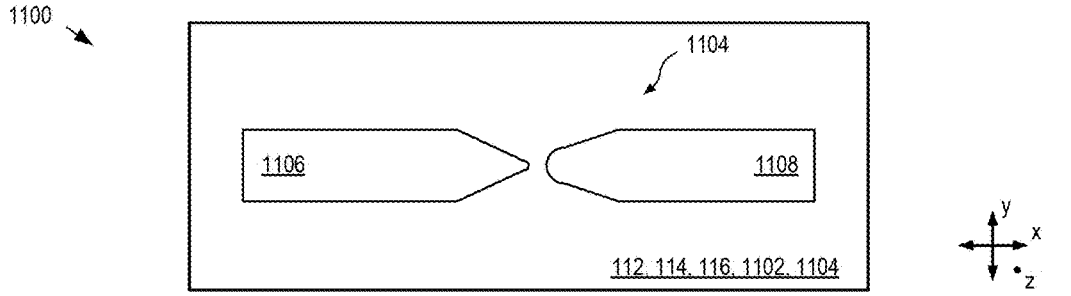

FIGS. 11A-B depict top and cross-sectional views of nascent device 1100 after the formation of lift-off mask 1104.

At operation 1003, conductive layer 1110 is deposited on mask 1104. Typically, conductive layer 1110 also includes an underlying adhesion layer that promotes adhesion between conductive layer 1110 and dielectric layer 1102. In the depicted example, conductive layer 1110 includes a thin (5-nm thick) layer of aluminum oxide underneath a layer of chrome having a thickness of approximately 30 nm. In some embodiments, conductive layer 1110 comprises a different electrically conductive material suitable for use as an electrode (gate, emitter, or collector) in a field-emission device. In some embodiments, the adhesion layer comprises a different material that promotes adhesion between these layers. One skilled in the art will recognize that the choice of material for the adhesion layer depends on the materials that compose dielectric layer 1102 and conductive layer 1110.

Preferably, conductive layer 1110 includes a material that has a high work function, while dielectric layer 1102 is made of a material having a high dielectric strength. Such a combination of materials mitigates leakage current that can occur through field emission from the gate and/or from leakage through the dielectric layer. The use of chrome for gates 902-1 and 902-2 is particularly attractive, since it has a work function of 4.5 eV and is easily etched.

At operation 1004, hard-mask layer 1112 is deposited on conductive layer 1110.

Hard-mask layer 1112 is a layer of material suitable for use as a mask during DRIE and other etching processes used to define the structure of device 900. In the depicted example, hard-mask layer 1112 comprises a layer of aluminum oxide having a thickness of approximately 40 nm. In some embodiments, a different material is used in hard-mask layer 1112.

At operation 1004, a lift-off process is used to remove mask 1104 and the unwanted material of layers 1110 and 1112.

Figure 11C:
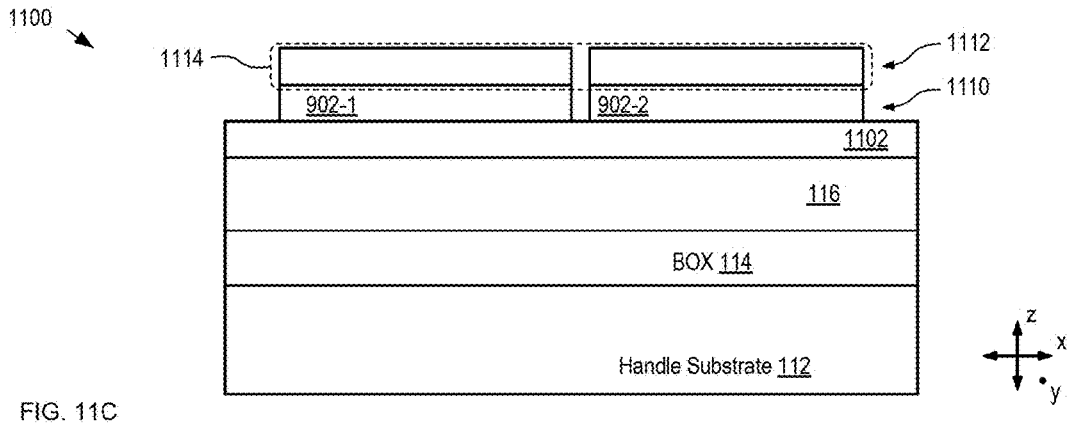

FIG. 11C depicts a cross-sectional view of nascent device 1100 after operation 1004. After lift-off, the regions of hard-mask layer 1114 that remain after the lift-off procedure collectively define hard mask 1114, while the remaining portions of conductive layer 1110 define gate electrodes 902-1 and 902-2.

At operation 1005, the pattern of hard mask 1114 is transferred into dielectric layer 1102 and active layer 116 to define emitter 102, collector 104, insulators 904-1 and 904-2, and gap g2. In the depicted example, g2 has separation, s2, of approximately 68 nm. Typically, the pattern of hard mask 1114 is transferred into its underlying layers is performed via conventional plasma etching and DRIE.

Figure 11D:
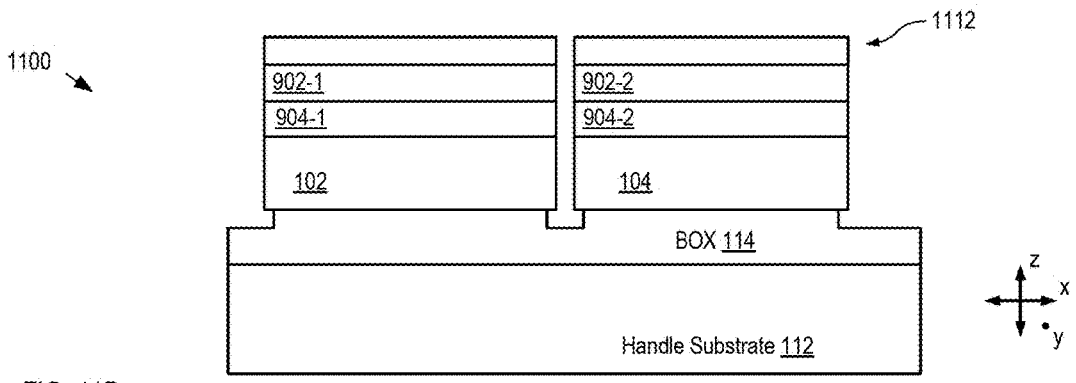

FIG. 11D depicts a cross-sectional view of nascent device 1100 after operation 1005. As shown in FIG. 11D, after its use as a hard mask, the remaining material of hard-mask layer 1112 is left intact to act as a passivation and insulating layer that enables the formation of interconnect traces between device 900 and other devices on substrate 110.

It should be noted that operations 1002 through 1005 collectively enable formation of gates 902-1 and 902-2 such that are self-aligned with emitter 102 and collector 104, respectively.

At optional operation 1006, the exposed surface regions of BOX 114 are relieved slightly by etching into the BOX layer via a selective oxide etch. By relieving these surfaces, leakage paths along the surface between emitter 102 and collector 104 are lengthened, inhibiting Frenkel-Poole current leakage, as discussed above and with respect to operation 206 of method 200.

At operation 1007, vias 1114 are formed to expose surface regions of emitter 102, collector 104, and gates 902-1 and 902-2.

Figure 11E:
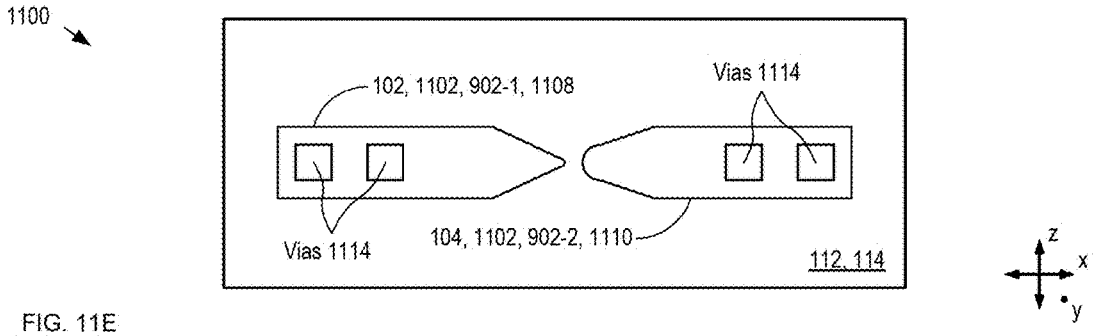
Figure 11F:
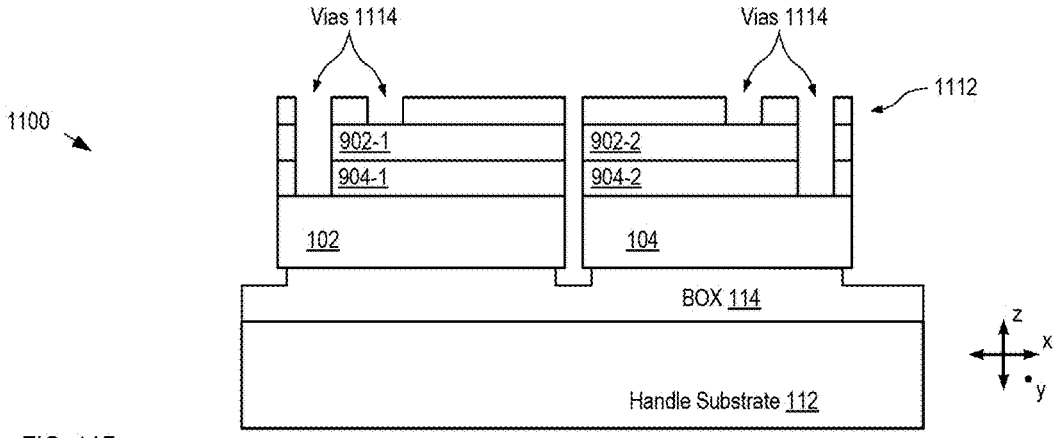

FIGS. 11E-F depict top and cross-sectional views of nascent device 1100 after the definition of vias 1114. Typically, the vias are formed in multiple photolithography and etching steps.

At operation 1008, contacts 106 and 108 are formed on emitter 102 and collector 104, respectively, and contacts 908-1 and 908-2 are formed on gates 902-1 and 902-2, respectively.

Although the depicted example includes a stacked structure having gate electrodes that are formed on the emitter and collector electrodes (i.e., the emitter and collector electrodes are between their respective gate electrodes and the substrate), some embodiments include a stacked structure in which at least one gate electrode is underneath an emitter or collector electrode (i.e., between the emitter/collector electrode and the substrate). In some embodiments, a stacked structure includes gate electrodes both above and below its respective emitter/collector electrode.

Figure 12:
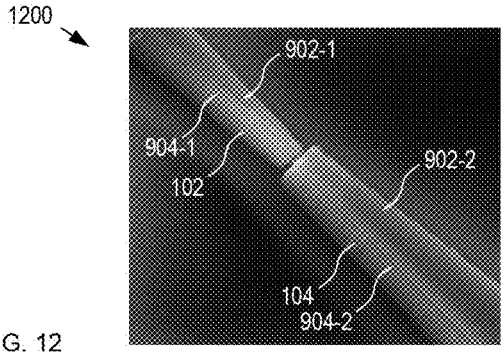
FIG. 12 depicts a scanning-electron-microscope photograph of a four-terminal field-emission device in accordance with the first alternative embodiment of the present invention.

FIG. 12 depicts a scanning-electron-microscope photograph of a four-terminal field-emission device in accordance with the first alternative embodiment of the present invention. Device 1200 includes emitter 102 and collector 104 and two, independently addressable gates 902-1 and 902-2. As described above, emitter 102 and collector 104 are made of doped-silicon, while the gates are made of chrome. Aluminum oxide insulators 904-1 and 904-2 electrically isolate the emitter and collector from their respective gates.

Figure 13:
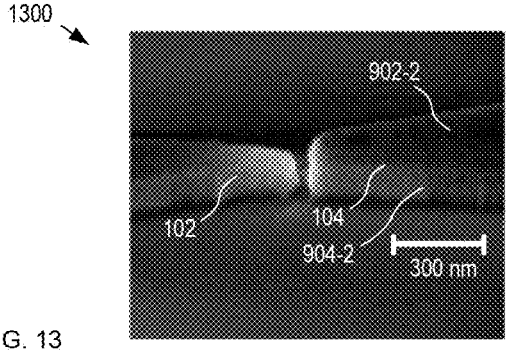
FIG. 13 depicts a scanning-electron-microscope photograph of a three-terminal field-emission device in accordance with the present invention.

FIG. 13 depicts a scanning-electron-microscope photograph of a three-terminal field-emission device in accordance with the present invention. Device 1300 is analogous to device 1200; however, the gate and insulator are removed from emitter 102.

Figure 14:
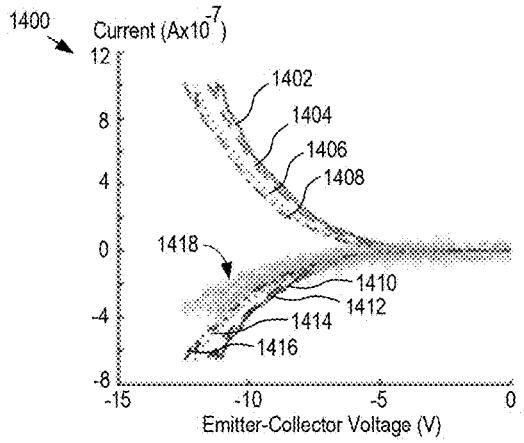
FIG. 14 depicts a current-voltage plot for a three-terminal device analogous to device 1300.

FIG. 14 depicts a current-voltage plot for a three-terminal device analogous to device 1300. Plot 1400 includes traces 1402, 1404, 1406, and 1408, which are the detected emitter currents at voltages applied to gate 902-2 of 0, −0.5, −1.0, and −1.25 volts, respectively.

Plot 1400 also includes traces 1410, 1412, 1414, and 1416, which are the detected collector currents at voltages applied to gate 902-2 of 0, −0.5, −1.0, and −1.25 volts, respectively.

Trace 1418 is the leakage current detected at gate 902-2 under the same bias conditions.

Plot 1400 evinces that, as the voltage on gate 902-2 is decreased, the electric field at the emitter tip is reduced, which, in turn, reduces the Fowler-Nordheim current between the emitter and collector. Emitter 102 emits electrons into both collector 104 and gate 902-2, with a ratio of approximately 1.75:1.

In some embodiments, a voltage is applied to each of gates 902-1 and 902-2 to deplete the doped silicon of emitter 102 and collector 104 of free charge carriers, thereby suppressing field-emission current.

Figure 15:
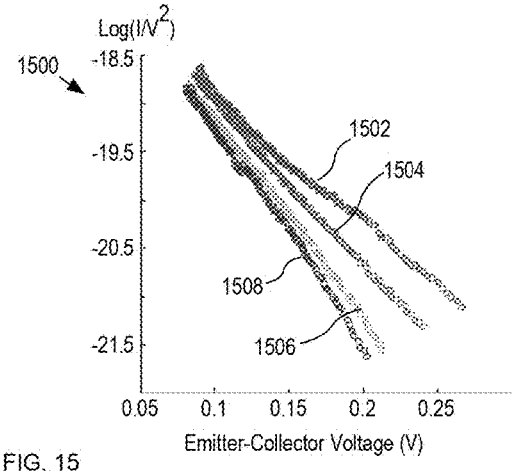
FIG. 15 depicts a plot of the Fowler-Nordheim characteristic for a three-terminal field-emission device in accordance with the present invention.

FIG. 15 depicts a plot of the Fowler-Nordheim characteristic for a three-terminal field-emission device in accordance with the present invention. Plot 1500 shows that a change in the voltage applied to gate 902-2 modifies field emission between emitter 102 and collector 104. Plot 1500 includes traces 1502, 1504, 1506, and 1508, which represent the response for gate voltages of 0, −0.5, −1.0, and −1.25 volts, respectively.

Figure 16:
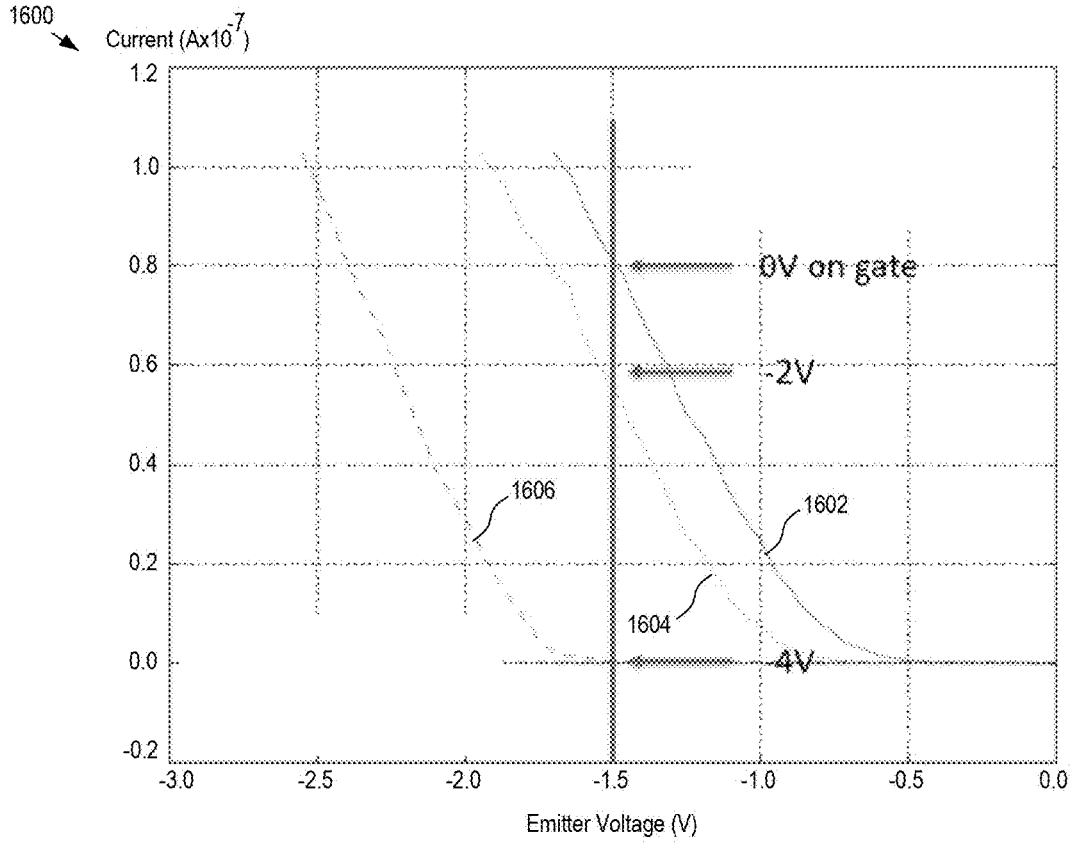
FIG. 16 depicts a plot of atmospheric-pressure operation of an emitter-follower device configuration comprising a three-terminal field-emission device in accordance with the present invention.

FIG. 16 depicts a plot of atmospheric-pressure operation of an emitter-follower device configuration comprising a three-terminal field-emission device in accordance with the present invention. Plot 1600 includes traces 1602, 1604, and 1606, which represent measured field-emission current between emitter 702 and collector 704 at different voltages applied to gate 706 of triode device 700 described above. Traces 1602, 1604, and 1606 correspond to gate voltages of 0, −2, and −4 volts, respectively.

Plot 1600 shows that device 700 can successfully function as an amplifier having a turn-on voltage that can be modulated by a voltage applied its gate.

Figure 17A:
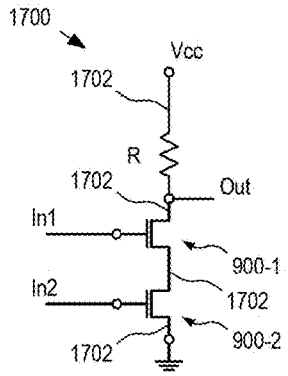
FIGS. 17A-B depict a circuit diagram and mask layout, respectively, of an integrated-circuit in accordance with the present invention.
Figure 17B:
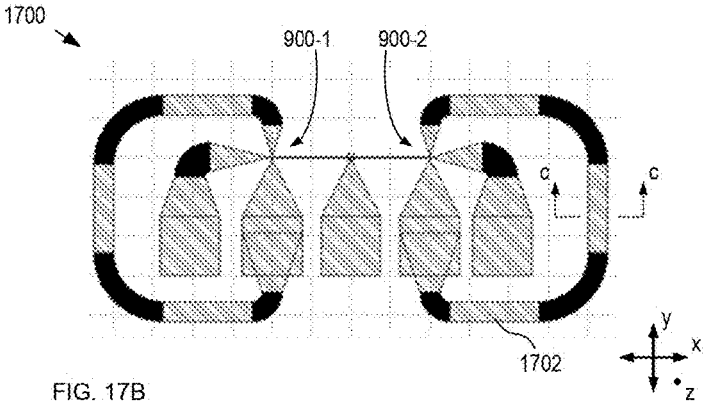

FIGS. 17A-B depict a circuit diagram and mask layout, respectively, of an integrated-circuit in accordance with the present invention. Circuit 1700 comprises devices 1702-1 and 1702-2, resistor R, and a plurality of traces 1704, which are electrically connected to realize a basic NAND gate circuit.

Each of devices 1702-1 and 1702-2 (referred to, collectively, as devices 1702) is analogous to device 900 described above; however, in devices 1702-1 and 1702-2, each of emitter 102, collector 104, and gates 902-1 and 902-2 are made of a metal and the gates are electrically connected to define a single gate electrode in each device.

Each of traces 1704 is a plasmonic interconnect. Trace 1704 is described in more detail below and with respect to FIG. 18.

In some embodiments, at least one of traces 1704 is a conventional metal trace, such as a CMOS integrated-circuit interconnect.

One skilled in the art will recognize that one of the advantages of field-emission devices is that an individual device can be operated at frequencies far higher than those achievable with conventional CMOS devices—even at terahertz (THz) frequencies. Such high-frequency operation is enabled by the fact that the modulation frequency of a field-emission device is not limited by the mobility limitations and/or saturation velocities that result from carrier scattering in solids. Unfortunately, although the operating frequency of a nanotriode-based integrated circuit is no longer limited by the modulation frequency of the individual devices, the distributed capacitance and inductance of conventional metal interconnects between the devices represent potential barriers to THz-frequency operation. Reducing interconnect lengths and applying complex synchronization approaches offer some potential for improvement; however, the operating frequency of complex circuits will ultimately be limited by scattering in interconnects used to connect individual triodes.

Figure 18:
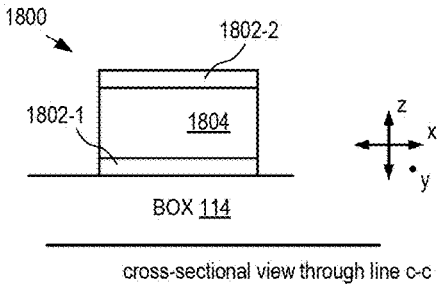
FIG. 18 depicts a schematic drawing of a cross-sectional view of a plasmonic interconnect in accordance with the present invention.

FIG. 18 depicts a schematic drawing of a cross-sectional view of a plasmonic interconnect in accordance with the present invention. Trace 1704 comprises a sandwich structure comprising metal layers 1802-1 and 1802-2 and dielectric 1804, which collectively define a metal-insulator-metal plasmonic interconnect that enables propagation of plasmons along its length at speeds approaching the speed of light.

Each of metal layers 1802-1 and 1802-2 comprises a layer of chrome having a thickness of approximately 30 nm. In the depicted example, metal layer 1802-1 and the emitters and collectors of devices 1702 are formed at the same time by patterning a metal layer disposed on an insulator layer, as described above and with respect to operation 207 of method 200. Metal layer 1802-2 includes a region of conductive layer 1110 and is formed at the same time as gates 902-1 and 902-2. Each of the emitters and collectors is electrically connected with a trace 1704 such that plasmon waves generated in one of the electrodes can couple into the trace and propagate to other devices in the circuit, as described below. In some embodiments, at least one of metal layers 1802-1 and 1802-2 comprises a different metal, such as gold, silver, platinum, tungsten, titanium, titanium-tungsten, and the like.

Dielectric 1804 is a layer of aluminum oxide having a thickness of approximately 40 nm. In the depicted example, dielectric 1804 includes a region of dielectric layer 1102 and is formed at the same time as insulators 904-1 and 904-2. In some embodiments, dielectric 1804 is a portion of a different dielectric layer than insulators 904-1 and 904-2.

In some embodiments, devices 1702-1 and 1702-2 are formed using materials that are known to exhibit plasmonic activity in the visible wavelength range, which facilitates integration of electron optics and photonics. For example, gold is a noble metal that is known to exhibit a plasmonic resonance at optical wavelengths of approximately 600 nm.

In the depicted example, electrons emitted from the field-emitting cathode of device 1702-1 collide with the metal elements of its anode to produce a plasmonic wave (i.e., electrical-to-optical conversion (EO) occurs), which propagates from the point of impact to couple into trace 1704. Examples of such EO conversion is described by Canneson, et al., in "Surface plasmon polariton beams from an electrically excited plasmonic crystal," in *Optics Express*, Vol. 24, pp. 26186-26200 (2016), which is incorporated herein by reference.

Once coupled into trace 1704, the plasmons propagate along the interfaces between dielectric 1804 and each of metal layers 1802-1 and 1802-2 to device 1702-2.

At the field-emitting cathode of device 1702-2, the plasmons in trace 1704 are focused such that the high electric-field confinement of the focused plasmonic light approaches the critical field needed to produce cold-field emission from the cathode. As a result, device 1702-2 is gated by the incoming plasmonic light (i.e., optical-to-electronic (OE) conversion takes place).

It should be noted that, while metal-based electrodes are preferable for enabling OE and EO conversion at devices 1702, other materials (e.g., highly doped semiconductors, metal-semiconductor bi-layers, tri-layers, etc.) can be used in plasmonic-trace-based devices without departing from the scope of the present invention.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An apparatus including a first field-emission device, the first field-emission device comprising:

a substrate;

a first electrode disposed on the substrate, the first electrode having a tip whose radius of curvature is at least 20 nm;

a second electrode disposed on the substrate, the second electrode having a tip whose radius of curvature is at least 20 nm, wherein the first electrode and second electrode define a first gap having a first environment that is characterized by an ionization potential; and a third electrode;

wherein the first electrode, second electrode, and third electrode are dimensioned and arranged such that (1) a first voltage between the first electrode and second electrode gives rise to a field-emission current between the first electrode and second electrode and (2) the magnitude of the field-emission current is based on a second voltage between the third electrode and one of the first and second electrodes;

wherein the first gap has a first separation that enables field emission of electrons from one of the first electrode and second electrode with an electron energy that is less than the ionization potential.

2. The apparatus of claim 1 wherein the first gap is less than 200 nanometers.

3. The apparatus of claim 1 wherein the first gap is less than or equal to 100 nanometers.

4. The apparatus of claim 1 further comprising a mixed-technology integrated circuit, wherein the mixed-technology integrated circuit includes a CMOS device and the first field-emission device.

5. The apparatus of claim 1 further comprising a first element that includes a first layer stack comprising the first electrode, the third electrode, and a first insulator that is located between the first electrode and the third electrode.

6. The apparatus of claim 5 further comprising a second element that includes a second layer stack comprising the second electrode, a fourth electrode, and a second insulator that is located between the second electrode and the fourth electrode, wherein first electrode, second electrode, third electrode, and fourth electrode are dimensioned and arranged such that the magnitude of the field-emission current is further based on a third voltage between the fourth electrode and one of the first and second electrodes.

7. The apparatus of claim 5 wherein each of the first and second electrodes comprises a semiconductor having a first free-carrier concentration when the magnitude of the second voltage is substantially zero, and wherein the semiconductor has a second free-carrier concentration that is lower than the first free-carrier concentration when the second voltage has a non-zero magnitude.

8. The apparatus of claim 1 wherein the apparatus includes a circuit that includes the first field-emission device and a second field-emission device that comprises:

a third electrode disposed on the substrate; and a fourth electrode disposed on the substrate, wherein the third electrode and fourth electrode define a second gap having the first environment;

wherein the second gap has a second separation that enables field emission of electrons from one of the third electrode and fourth electrode with an electron energy that is less than the ionization potential.

9. The apparatus of claim 8 further comprising at least one plasmonic interconnect that operatively couples the first field-emission device and the second field-emission device.

10. An apparatus including a first field-emission device, the first field-emission device comprising:

a substrate;

a first electrode disposed on the substrate;

a second electrode disposed on the substrate, wherein the first electrode and second electrode are co-planar and define a first gap having a first environment;

a third electrode; and a first element that includes a first layer stack comprising the first electrode the third electrode and a first insulator that is located between the first electrode and the third electrode;

wherein the first electrode, second electrode, and first gap are configured to enable a field-emission current between the first electrode and second electrode when the first environment is at atmospheric pressure; and wherein magnitude of the field-emission current is based on a first voltage applied between the third electrode and one of the first and second electrodes.

11. The apparatus of claim 10 wherein the first gap is less than 200 nanometers.

12. The apparatus of claim 10 wherein the first gap is less than or equal to 100 nanometers.

13. The apparatus of claim 10 wherein each of the first electrode and second electrode comprises a metal.

14. The apparatus of claim 10 wherein each of the first electrode and second electrode comprises a doped semiconductor.

15. The apparatus of claim 10 wherein the first electrode comprises a first material having a first work function and the second electrode comprises a second material having a second work function that is different than the first work function.

16. The apparatus of claim 10 further comprising a second element, wherein the second element includes a second layer stack comprising the second electrode, a fourth electrode, and a second insulator that is located between the second electrode and the fourth electrode.

17. The apparatus of claim 1 further comprising a trace that is electrically conductive, the trace being electrically connected with the first field-emission device, wherein the trace is selected from the group consisting of a plasmonic interconnect and a CMOS integrated-circuit interconnect.

18. The apparatus of claim 10 wherein the first electrode has a first tip having a radius of curvature that is greater than 20 nm and less than infinity, and wherein the second electrode has a second tip that terminates at a substantially flat surface.

19. An apparatus including a circuit that comprises:

(1) a first field-emission device, the first field-emission device comprising:

(i) a substrate;

(ii) a first electrode disposed on the substrate, the first electrode having a tip whose radius of curvature is at least 20 nm; and (iii) a second electrode disposed on the substrate, the second electrode having a tip whose radius of curvature is at least 20 nm, wherein the first electrode and second electrode define a first gap having a first environment that is characterized by an ionization potential;

wherein the first gap has a first separation that enables field emission of electrons from one of the first electrode and second electrode with an electron energy that is less than the ionization potential; and (2) a second field-emission device that comprises:

(i) a third electrode disposed on the substrate; and (ii) a fourth electrode disposed on the substrate, wherein the third electrode and fourth electrode define a second gap having the first environment;

wherein the second gap has a second separation that enables field emission of electrons from one of the third electrode and fourth electrode with an electron energy that is less than the ionization potential.

20. The apparatus of claim 19 further comprising at least one plasmonic interconnect that operatively couples the first field-emission device and the second field- emission device.

* * * * *